US009751338B2

(12) United States Patent
Sekino et al.

(10) Patent No.: US 9,751,338 B2
(45) Date of Patent: Sep. 5, 2017

(54) DUAL PURPOSE PRINTING APPARATUS

(71) Applicant: TOSHIBA TEC KABUSHIKI KAISHA, Tokyo (JP)

(72) Inventors: Toshiharu Sekino, Shizuoka (JP); Kenji Eoka, Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/232,398

(22) Filed: Aug. 9, 2016

(65) Prior Publication Data

US 2016/0347089 A1 Dec. 1, 2016

Related U.S. Application Data

(62) Division of application No. 13/854,781, filed on Apr. 1, 2013, now Pat. No. 9,440,456.
(Continued)

(51) Int. Cl.

| | |
|---|---|
| ***B41J 11/00*** | (2006.01) |
| ***B41J 2/32*** | (2006.01) |
| ***B41J 3/54*** | (2006.01) |
| ***B41J 13/00*** | (2006.01) |
| ***B41J 3/60*** | (2006.01) |
| ***B41J 11/50*** | (2006.01) |
| ***B41J 15/04*** | (2006.01) |
| ***B41J 13/03*** | (2006.01) |

(52) U.S. Cl.
CPC ..... *B41J 11/0045* (2013.01); *B41J 2/32* (2013.01); *B41J 3/546* (2013.01); *B41J 3/60* (2013.01); *B41J 11/50* (2013.01); *B41J 13/00* (2013.01); *B41J 13/0018* (2013.01); *B41J 13/03* (2013.01); *B41J 15/042* (2013.01)

(58) Field of Classification Search
CPC ..... B41J 13/00; B41J 3/60; B41J 11/50; B41J 15/042
See application file for complete search history.

(56) References Cited

U.S. PATENT DOCUMENTS 5,063,395 A * 11/1991 Nuita ..... B41J 11/24 347/220
5,970,304 A 10/1999 Stemmle
(Continued)

FOREIGN PATENT DOCUMENTS

JP 2011173621 9/2011
JP 2011255681 A 12/2011

*Primary Examiner* — Julian Huffman
(74) *Attorney, Agent, or Firm* — Patterson & Sheridan, LLP

(57) ABSTRACT

According to one embodiment, a dual purpose printer has a housing, a printing medium supporting section, a first printing section, and a second printing section. The housing has a discharge port and an entrance port. The printing medium supporting section is arranged inside the housing, and rotatably supports a rolled printing medium. The first printing section is configured to print on a top surface of a first continuous sheet printing medium drawn from the rolled printing medium supported on the printing medium supporting section, and to print on a second printing medium carried in through the entrance port. The second printing section is arranged inside the housing, and is configured to print on the bottom surface of the first continuous sheet printing medium.

4 Claims, 6 Drawing Sheets

Related U.S. Application Data

(60) Provisional application No. 61/619,377, filed on Apr. 2, 2012.

(56) References Cited

U.S. PATENT DOCUMENTS

| | | | | |
|---|---|---|---|---|
| 5,988,903 | A * | 11/1999 | Baitz | B41J 11/48 347/104 |
| 7,708,360 | B2 | 5/2010 | Byerly et al. | |
| 2004/0265032 | A1 * | 12/2004 | Furihata | B41J 15/042 400/693 |
| 2007/0211134 | A1 * | 9/2007 | VanDemark | B41J 2/32 347/220 |
| 2011/0228289 | A1 | 9/2011 | Yamamoto et al. | |

* cited by examiner

DUAL PURPOSE PRINTING APPARATUS

CROSS-REFERENCE TO RELATED APPLICATIONS

This application is a division of U.S. patent application Ser. No. 13/854,781, filed on Apr. 1, 2013, which claims the benefit of priority from U.S. Provisional Patent Application No. 61/619,377, filed on Apr. 2, 2012; the entire contents of each of which are incorporated herein by reference.

FIELD

Embodiments described herein relate generally to a dual purpose printer, i.e., a printing apparatus which is capable of printing on both sides of a print medium pulled from a roll of print media and on a different print media.

BACKGROUND

In one known type of printer that prints on both sides of a print medium, for example, on paper withdrawn from a roll of paper, the cover of the printer housing must be opened to replace the paper roll. With the cover of the printer arranged in an open position, a roll of paper may be loaded into the hopper inside the housing for printing thereon.

For the two sided printer in the prior art, printing can be carried out only on paper drawn from the paper roll loaded inside the housing. There is, however a demand for a printer which can also be used for carrying out single-side printing on paper sheets, other than on paper supplied from the paper roll and then cut into sheets, such as printing on precut paper sheets, transparencies, etc.

DETAILED DESCRIPTION

Embodiments provide a dual function printer that can print on printing media other than rolled printing media.

Figure 1:
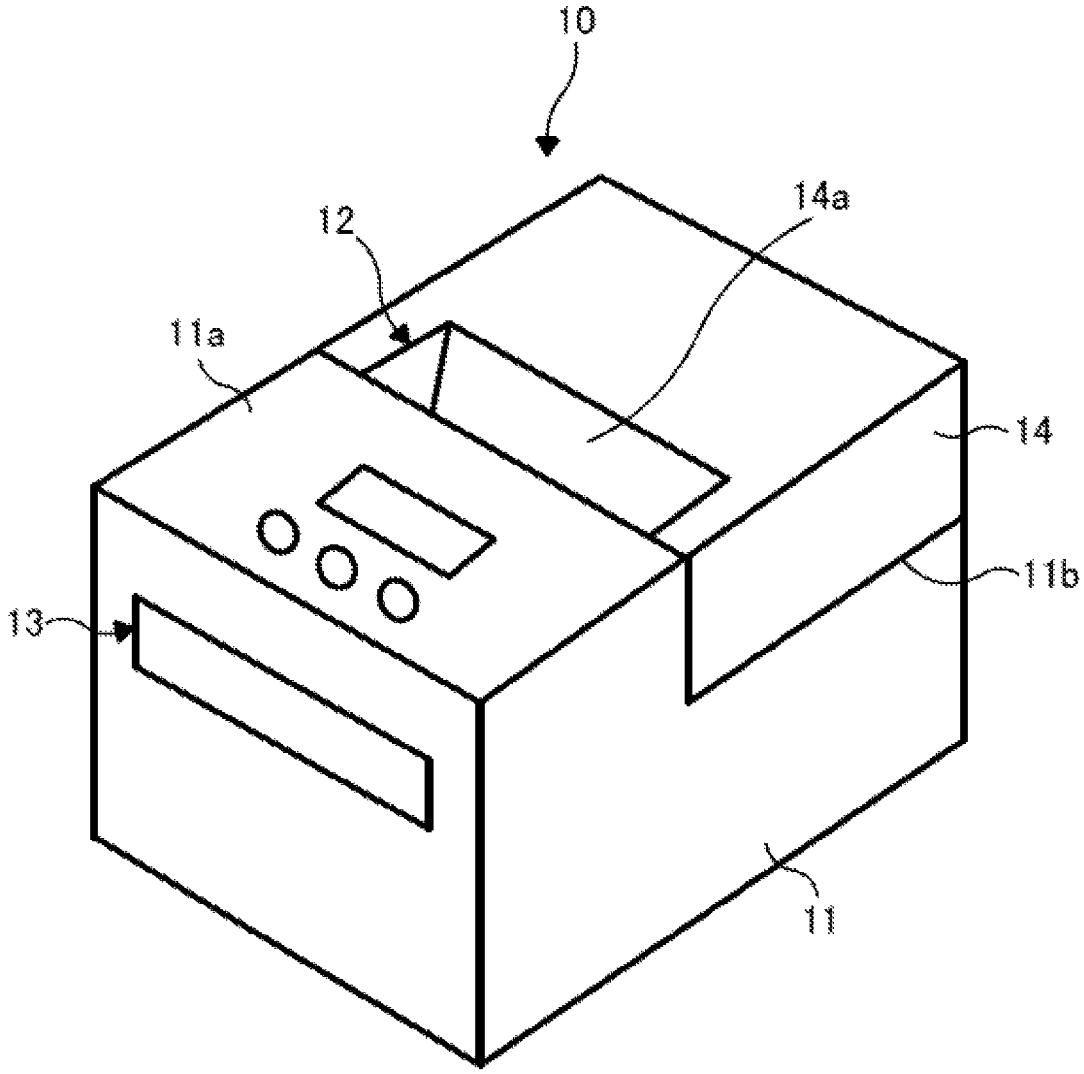
FIG. 1 is a diagram perspective view of a dual purpose printer according to an embodiment.

In general, according to one embodiment, the dual purpose printer according to the present embodiment will be explained. FIG. 1 is a diagram illustrating an appearance of a dual purpose printer according to the present embodiment.

A dual purpose printer 10 shown in FIG. 1 can print on a roll-shaped printing medium as a first printing medium and on a planar printing medium as a second printing medium. In the following, a printing medium formed as a continuous sheet wound as a roll will be referred to as the paper roll, or, paper received from the paper roll as a supply, while a precut or sized planar-shaped second printing medium will be referred to as cut paper sheet.

Figure 2:
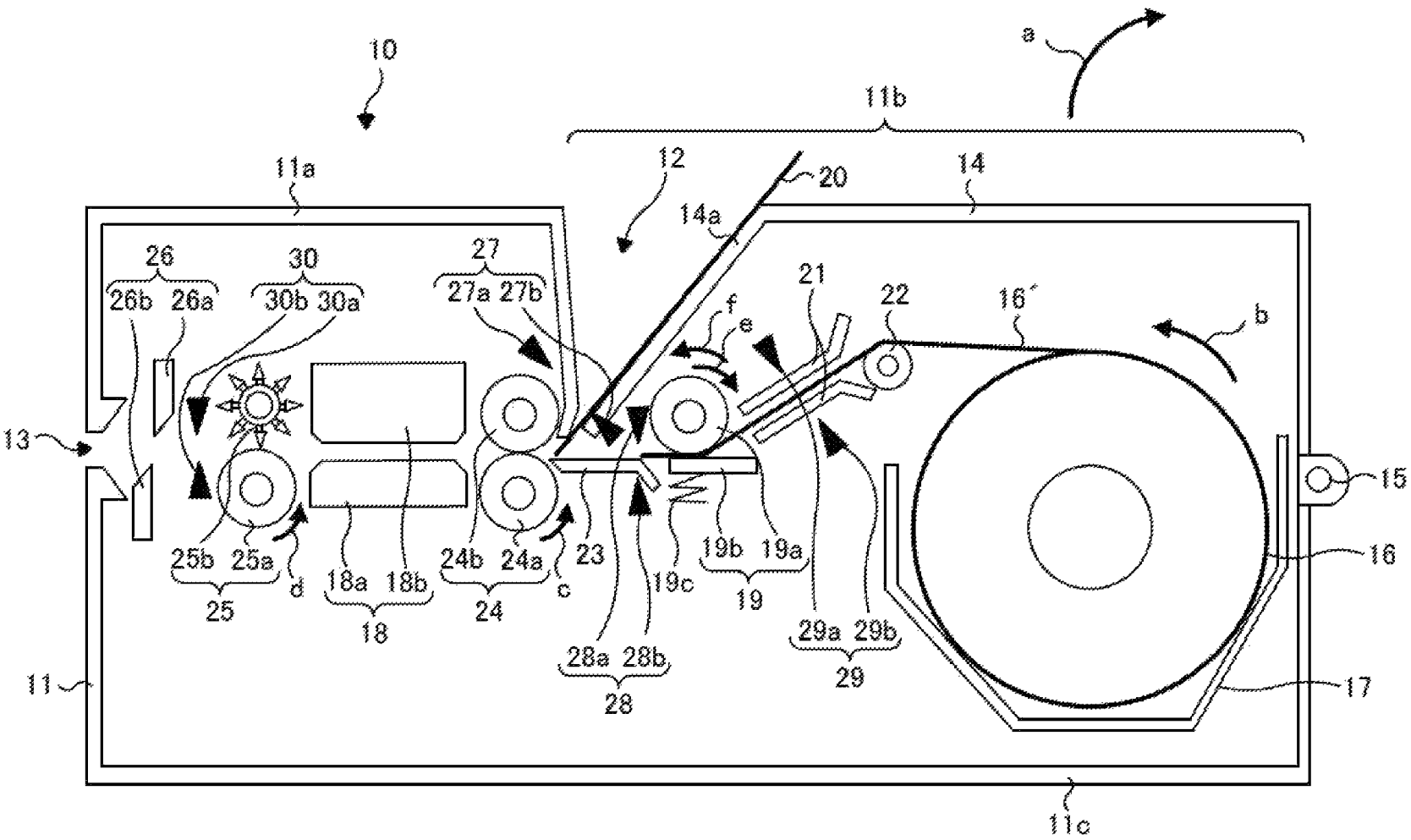
FIG. 2 is a sectional side view of a configuration of a dual purpose printer according to an embodiment.

As an overview of FIG. 2, the dual purpose printer of the embodiment has a housing, a printing medium supporting section, a first printing section, and a second printing section. The housing has a discharge port and an entrance port. The printing medium supporting section is arranged inside the housing, and it supports the first, rolled printing medium, to be rotatable to enable the feeding or pulling a continuous sheet of printing media therefrom, which after printing thereon, is singulated, or cut, into individual sheets. The first printing section can print on an upper or first side of the continuous sheets of first printing medium drawn from the first roll-shaped printing medium supported on the printing medium supporting section, and it can also print on a pre-cut planar-shaped printing medium carried in through the entrance port thereof. The second printing section is also arranged inside the housing, and it can carry out printing on the back or second side of the continuous sheet printing medium.

Referring to FIG. 1, in the dual purpose printer 10, a paper roll is loaded housing 11. On portions of the housing 11, an entrance port 12 where the pre-cut paper sheets can be loaded and a discharge port 13 for discharging the roll paper and the cut paper sheet are also provided.

The housing 11 has an opening portion 11*b* on a portion of a top surface 11*a* thereof. The housing 11 has a cover member 14 arranged on the opening portion 11*b*. The cover member 14 has an inwardly declining surface 14*a* inclined with respect to a bottom surface 11*c* of the housing 11, the end thereof which abuts the top surface 11*a*. The cover member 14 is arranged in the opening portion 11*b* of the housing 11 so that the entirety of the declining surface 14*a* is physically separated from the top surface 11*a* of the housing 11. The portion where the declining surface 14*a* of the cover member 14 is separated from the top surface 11*a* of the housing 11 becomes an entrance port 12 where the pre-cut paper sheets can be loaded. The declining surface 14*a* of the cover member 14 is inclined appropriately so that the pre-cut paper sheet can be held thereon, and slide towards the entrance port 12 as individual pre-cut sheets enter the housing of the dual purpose printer 10.

FIG. 2 is a sectional sideview illustrating a configuration of the dual purpose printer 10 according to the embodiment. As shown in FIG. 2, the cover member 14 is arranged at one end thereof on a hinge 15, such that it can be opened/closed with respect to the opening portion 11*b* of the housing 11. That is, the cover member 14 has its rear end connected, through hinge 15, to the upper end of the opening portion 11*b* of the housing 11, and it is arranged in the opening portion 11*b* of the housing 11 so that it can move in the direction indicated by the arrow a in the drawing around the hinge 15.

The housing 11, including the cover member 14 has the following internal sub-systems or parts: a hopper 17 bounding or forming printing medium supporting section that supports a paper roll 16 therein to rotate in the direction indicated by the arrow b, a first printing section 18 that prints on the outer side (top side thereof in FIG. 2) of the continuous sheet of paper 16' drawn from the roll paper 16, and a second printing section 19 that prints on the back side (lower side thereof in FIG. 2) of the continuous sheet of paper 16'.

The hopper 17 has an approximately U-shaped vertical cross-section. It is arranged below the cover member 14 and at a position spaced above the bottom 11*c* of the housing 11.

The first printing section 18 is arranged below the top surface 11*a* of the housing 11 and near the discharge port 13 of the housing and thus adjacent to a side surface of the housing 11 opposite to the position of the hinge 15 thereon. The first printing section 18 is a printing section that carries out printing on the outer or top side of the belt-shaped paper 16' using an the inkjet printing apparatus.

The first printing section 18 includes a paper guide 18*a* and an inkjet head 18*b*. The inkjet head 18*b* is located at a position spaced slightly above the upper surface of the paper guide 18*a*.

The first printing section 18 carries out printing with, e.g., the inkjet system, on the outer side of the continuous sheet of paper 16' when it is positioned between the inkjet head 18*b* and the paper guide 18*a*. In addition, the first printing section 18 may carry out printing with, e.g., the inkjet system, on a pre-cut paper sheet 20 fed thereto from the entrance port 12 of the housing 11.

The second printing section 19 is arranged below the cover member 14, and thus is positioned between the hopper 17 and the first printing section 18. The second printing section 19 is a printing section that carries out printing with, e.g., a thermal printing system which causes color change (typically clear or opaque to black), on the back side of the continuous sheet of paper 16' as a result of selective heating of regions of the heat sensitive paper of the paper roll.

The second printing section 19 has a platen roller 19*a* and a thermal head 19*b*. The platen roller 19*a* is anchored at a prescribed position in the housing 11, and it is configured to rotate.

The thermal head 19*b* is supported, from below, by a spring or other elastic member 19*c* arranged inside the housing 11. The thermal head 19*b* is arranged to press or push the paper from the roll extending therepast against the platen roller 19*a* by the elastic force of the elastic member 19*c*. The second printing section 19 carries out printing with, e.g., the thermal system, on the back side of the continuous sheet of paper 16' arranged between the thermal head 19*b* and the platen roller 19*a*.

Within housing 11 are transporting passages for the continuous sheet of paper 16' and the pre-cut paper sheet 20, and a transporting unit for transporting the continuous sheet of paper 16' or the pre-cut paper sheet 20 through the housing 11 to affect printed thereon.

The transporting passage has a first transporting passage 21 arranged between the hopper 17 and the second printing section 19, a first conveyor roller 22 arranged upstream, in the path of the continuous sheet of paper, of the first transporting passage 21, and a second transporting passage 23 arranged between the second printing section 19 and the first printing section 18 and adjacent to the entrance port 12 of the housing 11 where pre-cut sheets may be fed in the housing 11.

The continuous sheets paper 16' drawn from the paper roll 16 loaded in the hopper 17 is transported via the first conveyor roller 22 and the first transporting passage 21 to the second printing section 19. After passing through the second printing section 19, the continuous sheet of paper 16' is transported via the second transporting passage 23 to the first printing section 18. In addition, pre-cut paper sheets 20, fed into the entrance port 12 of the housing 11, are also transported via the second transporting passage 23 to the first printing section 18.

The transporting unit has a conveyor roller pair 24 arranged between the first printing section 18 and the second transporting passage 23, and a discharge roller pair 25 arranged between the first printing section 18 and the discharge port 13 of the housing 11.

The conveyor roller pair 24 includes a conveyor roller 24*a* rotating in the direction indicated by the arrow c as shown in the drawing due to rotation of the shaft of a motor coupled to the axis thereof, and a pinch roller 24*b* that is a slave roller, and thus driven in rotation by the rotation of the conveyor roller 24*a*. As the conveyor roller pair 24 rotate, the continuous sheet of paper 16' or the pre-cut paper sheet 20 on the second transporting passage 23 is transported to the first printing section 18. As the pre-cut paper sheet 20 is fed thereto, the inner edge thereof will slide a/on the upper surface of the plate forming first transporting passage 23, and thus be pinched between rotating rollers 24*a,b* and fed in the direction of the first printing section 18.

The discharge roller pair 25 includes a discharge roller 25*a* that rotates in the direction indicated by the arrow d shown in the drawing due to rotation of the motor, and a pinch roller 25*b* that is slaved there to and thus rotate as a result of rotation of discharge roller 25*a*. Due to rotation of the discharge roller pair 25, the continuous sheet of paper 16' or the pre-cut paper sheet 20 present in the first printing section 18 is transported to the discharge port 13.

In addition, the platen roller 19*a* of the second printing section 19 also forms a portion of the transporting unit. As the motor connect to the platen roller 19*a* rotates to rotate the platen roller 19*a* in the direction indicated by the arrow e as shown in the drawing, the continuous sheet of paper 16' drawn from the paper roll 16 is transported in the direction of the discharge port 13 of housing 11. In addition, this motor may be rotated, and thus the platen roller 19*a*, may be rotated in a reverse direction indicated by the arrow f as shown in the drawing, so that the continuous sheet of paper 16' is transported rearwardly in the direction of the hopper 17 and thus paper roll 16.

In addition, a cutting section 26 for cutting the continuous sheet of paper 16' is arranged between the discharge roller pair 25 and the discharge port 13 of the housing 11 inside the housing 11. After printing on the continuous sheet, the sheet may be singulated, or cut into individual sheets, at the cutting section 26 which includes an upper blade portion 26*a* and a lower blade portion 26*b* which may be moved together and slightly past each other to cut an individual piece of printed media from the continuous sheet of paper 16'.

In this dual purpose printer 10, a first sensor 27 is arranged near the entrance port 12 where pre-cut sheets may be fed into the housing 11, and a second sensor 28 is arranged in the downstream portion of the second transporting passage 23, upstream, in the direction of paper flow 16', from entrance part 12. In addition, a third sensor 29 is arranged in the first transporting passage 21 located upstream of second printing section 19, and a fourth sensor 30 is arranged between the discharge rollers 25 and the cutting section 26. The first sensor 27, second sensor 28, third sensor 29 and fourth sensor 30 are sensors which detect whether there exists the continuous sheet of paper 16' or the cut paper sheet 20 near the respective sensors.

The first sensor 27, second sensor 28, third sensor 29 and fourth sensor 30 may be made of light emitting LEDs 27*a*, 28*a*, 29*a*, and 30*a*, and receivers 27*b*, 28*b*, 29*b*, and 30*b* that receive the light rays emitted from the light emitting LEDs 27*a*, 28*a*, 29*a*, and 30*a*, respectively. As to be explained later, the first sensor 27, second sensor 28, third sensor 29 and fourth sensor 30 detect the local presence of the continuous sheet of paper 16' or of a pre-cut paper sheet 20 thereby.

That is, when the continuous sheet of paper 16' or a pre-cut paper sheet 20 is not present between the light emitting LEDs 27*a*, 28*a*, 29*a*, and 30*a* and the receivers 27*b*, 28*b*, 29*b*, and 30*b*, the light rays emitted from the light emitting LEDs 27*a*, 28*a*, 29*a*, and 30*a* reach the receivers 27*b*, 28*b*, 29*b*, and 30*b*, at their original intensity. As the receivers 27*b*, 28*b*, 29*b*, and 30*b* receive the light rays with high intensity, it is recognized that there exists no continuous sheet of paper 16' or pre-cut paper sheet 20 between the light emitting LEDs 27*a*, 28*a*, 29*a*, and 30*a* and the respective receivers 27*b*, 28*b*, 29*b*, and 30*b*.

On the other hand, when the continuous sheet of paper 16' or the pre-cut paper sheet 20 is present between the light emitting LEDs 27*a*, 28*a*, 29*a*, and 30*a* and the receivers 27*b*, 28*b*, 29*b*, and 30*b*, the intensity of the light rays emitted from the light emitting LEDs 27*a*, 28*a*, 29*a*, and 30*a* is attenuated, or blocked, by the continuous sheet of paper or the pre-cut paper sheet or located between a light source and related detector, receivers, When the receivers 27*b*, 28*b*, 29*b*, and 30*b* receive such light with a lower intensity, it is recognized that the continuous sheet of paper 16' or a pre-cut paper sheet 20 exists between the light emitting LEDs 27*a*, 28*a*, 29*a*, and 30*a* and the respective receivers 27*b*, 28*b*, 29*b*, and 30*b*.

Figure 3:
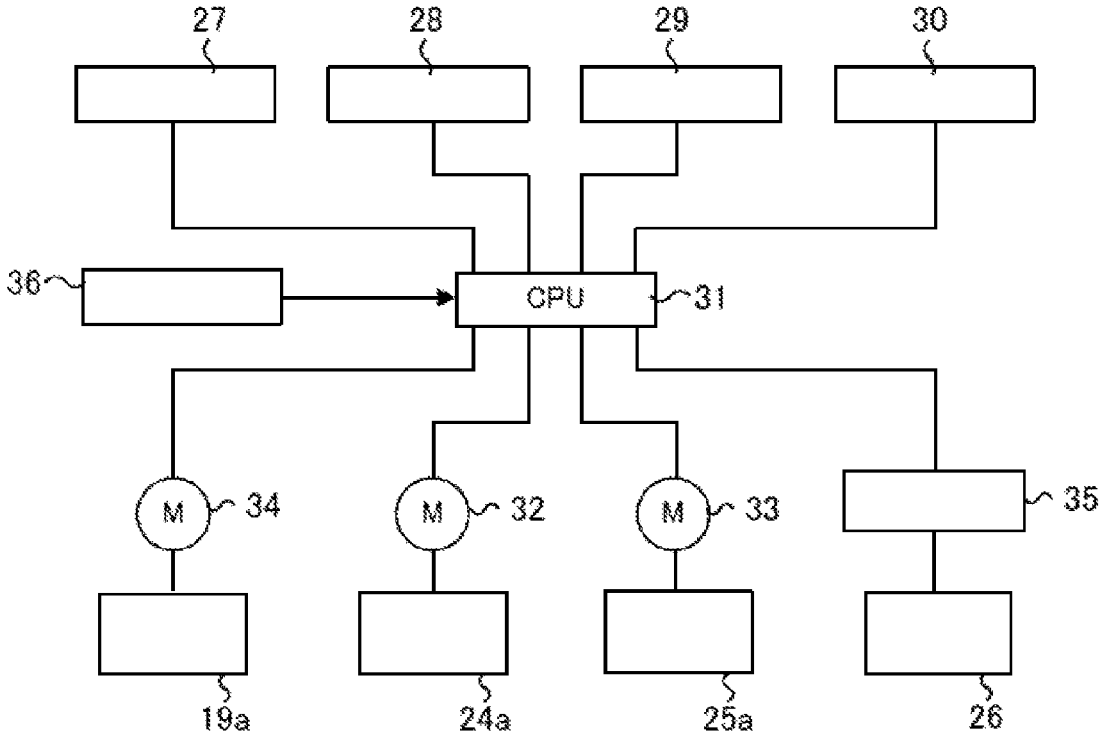
FIG. 3 is a block diagram illustrating the configuration of the electrical connection of the conveyance system of the dual purpose printer according to an embodiment.

FIG. 3 is block diagram illustrating the configuration of the electrical connection of the conveyance system of the dual purpose printer 10 explained above.

As shown in FIG. 3, the first sensor 27, second sensor 28, third sensor 29 and fourth sensor 30 used to detect a print media in a printing path are each connected to a CPU 31. Also, the motor 32, motor 33, and motor 34 which are connected to the conveyor roller 24*a*, the discharge roller 25*a*, and the platen roller 19*a* respectively are likewise connected to the CPU 31. A control section 35 for controlling the operation of the cutting section 26 to cut individual sheets from the continuous sheet 16' of rolled paper is also connected to the CPU 31, as is an operation instruction section 36 that issues the desired instructions to the CPU 31.

In the following, the operation of the dual purpose printer 10 explained above will be explained with reference to FIG. 3 as well as FIGS. 4 to 8. Here, FIGS. 4 to 8 are schematic diagrams illustrating the configuration for of the dual purpose printer used to explain the operation thereof.

Figure 4:
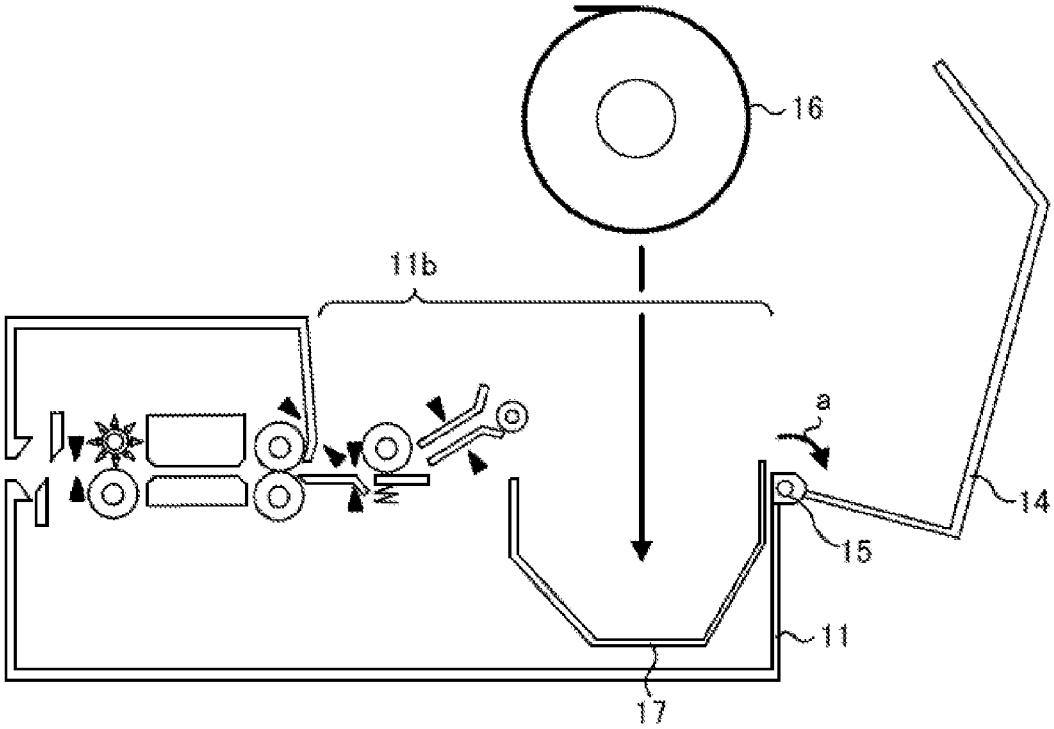
FIG. 4 is a schematic diagram illustrating a configuration for explaining an operation of the dual purpose printer according to an embodiment.

The double-sided printing operation on the continuous sheet pulled the roll paper 16 will be explained with reference to FIGS. 2 and 4, to load a roll of print media, such as a paper roll 16 into the printer, the cover member 14 is swung in the direction indicated by arrow 'a' as shown in FIG. 2 by pivoting at the hinge 18, so that the opening portion 11*b* of the housing 11 is opened. Then, the roll of paper 16 is set in the hopper 17 via the opening portion 11*b* of the housing 11.

Figure 5:
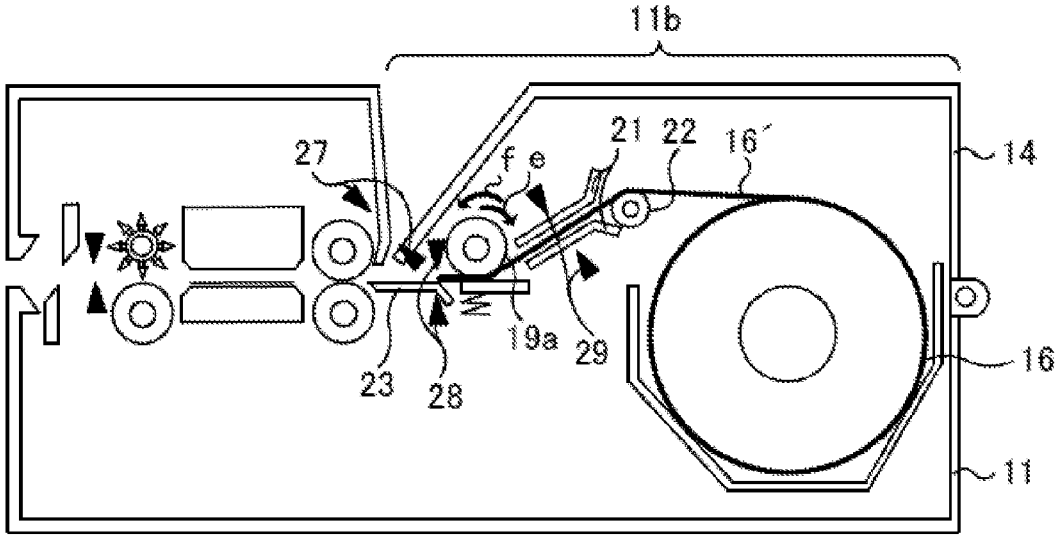
FIG. 5 is a schematic diagram illustrating the configuration for explaining the operation of the dual purpose printer according to an embodiment.
Figure 6:
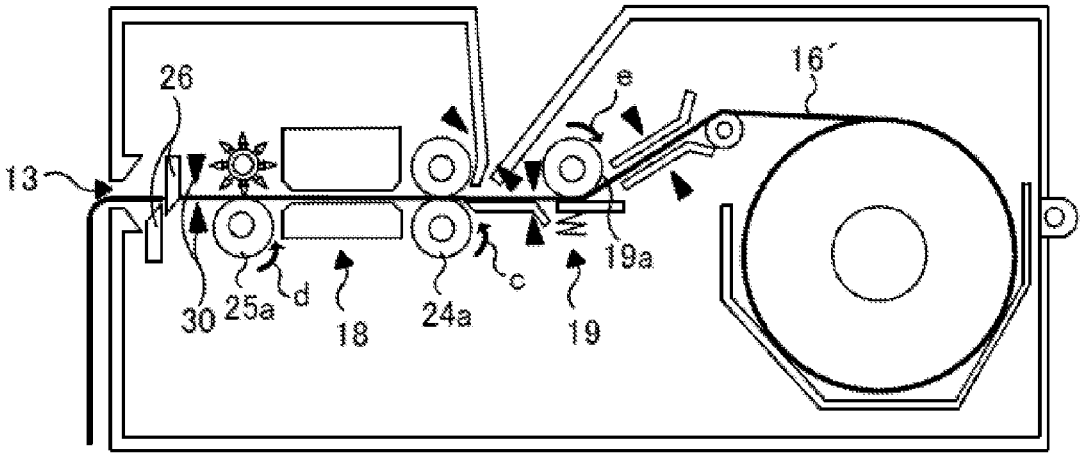
FIG. 6 is a schematic diagram illustrating the configuration for explaining the operation of the dual purpose printer according to an embodiment.

Then, as shown in FIG. 5, the end of the continuous sheet of paper 16' is drawn from the paper roll 16, and, as the tip of the continuous sheet of paper 16' is detected by the third sensor 29 arranged in the first transporting passage 21, the CPU 31 activates the motor 34 to rotate the platen roller 19*a*, in the direction indicated by the arrow e (forward direction) as shown in FIG. 6.

As the continuous sheet of paper 16' is further transported and the tip of the continuous sheet of paper 16' is detected by the second sensor 28 arranged in the downstream portion of the second transporting passage 23, the CPU 31 causes the motor 34, and thus the platen roller 19*a*, to stop. At this point, the dual purpose printer 10 is in a standby mode.

During loading of the continuous sheet of paper 16', if the end of the paper is detected by the second sensor 28, an additional step is performed. When the tip of the continuous sheet of paper 16' is detected by the second sensor 28, the CPU 31 activates the motor 34 to rotate the platen roller 19*a*, so that the platen roller 19*a* is rotated in the direction indicated by the arrow f (backward direction), so that the continuous sheet of paper 16' is reverse transported by a prescribed distance, without getting exiting the space between platen roller 19*a* a thermal head 19*a*, and, as shown in FIG. 5, the dual purpose printer 10 is again in a standby state.

The operation in which the continuous sheet of paper 16' is drawn out from the paper roll 16 and is transported forward until the tip of the continuous sheet of paper 16' contacts the platen roller 19*a* is carried out manually by the user while the opening portion 11*b* of the housing 11 is kept open.

With the dual purpose printer 10 in this standby state, suppose an instruction to start double-sided printing is issued from the operation section 36 of the host computer, or the like, to the CPU 31, the CPU 31 activates the motor 32, motor 33, and motor 34 that rotate the platen roller 19*a*, the conveyor roller 24*a* and the discharge roller 25*a*, respectively. As shown in FIG. 6, while the platen roller 19*a* is rotated in the forward direction, the conveyor roller 24*a* is rotated in the direction indicated by the arrow c as shown in the drawing (forward direction), and the discharge roller 25*a* is rotated in the direction indicated by the arrow d as shown in the drawing (forward direction). Due to rotation of the platen roller 19*a*, the conveyor roller 24*a*, and the discharge roller 25*a*, the continuous sheet of paper 16 passes through the second printing section 19, that printing section carries out printing on the paper 16' by thermal imaging on the back side of the continuous sheet of paper 16'. Then, after printing on the backside thereof in the second printing station 19, the continuous sheet of paper 16' is transported to the first printing section 18, and the first printing section 18 carries out printing with inkjet device on the outer (upper in the Fig.) side of the continuous sheet of paper 16'.

After printing on both sides of the, the continuous sheet of paper 16' is transported towards the discharge port 13 by the rotation of the discharge roller 25*a*, and, as the tip of the continuous sheet of paper 16' is detected by the fourth sensor 30, the CPU 31 controls to have the platen roller 19*a*, the conveyor roller 24*a*, and the discharge roller 25*a* rotated in the forward direction each by a prescribed quantity, so that the continuous sheet of paper 16' is transported by a prescribed quantity equal to the length of a printed sheet. Then, the CPU 31 control section 35 causes the cutting section 26 to cut the continuous sheet of paper 16' extending past the cutting section into an individual sheet. In this way, the double-sided printing operation of a single sheet comes to an end.

After the end of the double-sided printing operation, the CPU 31 controls the platen roller 19*a* to rotate in the reverse direction, so that the newly cut end of the continuous sheet of paper 16' left in the apparatus is transported rearwardly to the position shown in FIG. 5. As the tip (newly cut end) of the continuous sheet of paper 16' in the reverse transporting state is detected as it passes or reaches the second sensor 28, rotation of the platen roller 19*a* is stopped by the CPU 31, and the dual purpose printer becomes the standby state, once the newly cut end is positioned between the platen roller 19*a* and thermal head 19*b*, but is not extending into the entrance port 12.

Figure 7:
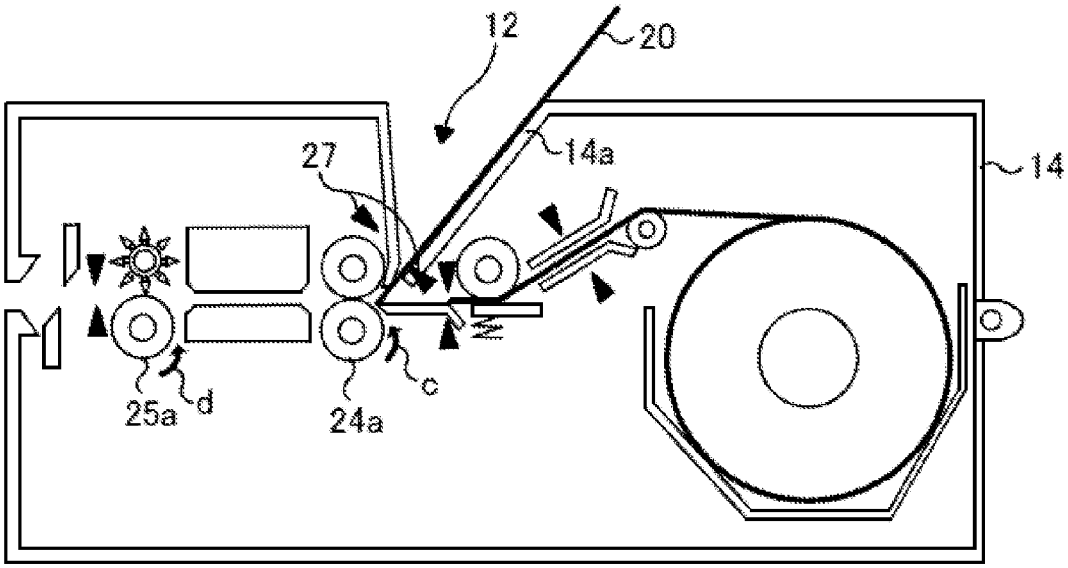
FIG. 7 is a schematic diagram illustrating the configuration for explaining the operation of the dual purpose printer according to an embodiment.

The single-side printing operation for the pre-cut paper sheet will be explained with respect to FIGS. 2 and 7. A pre-cut paper sheet 20 is set on the slope 14*a* arranged on the cover member 14 of the dual purpose printer 10 in the standby state. The presence of a pre-cut paper sheet 20 on the slope 14*a* is detected by the first sensor 27 arranged near the entrance port 12.

Figure 8:
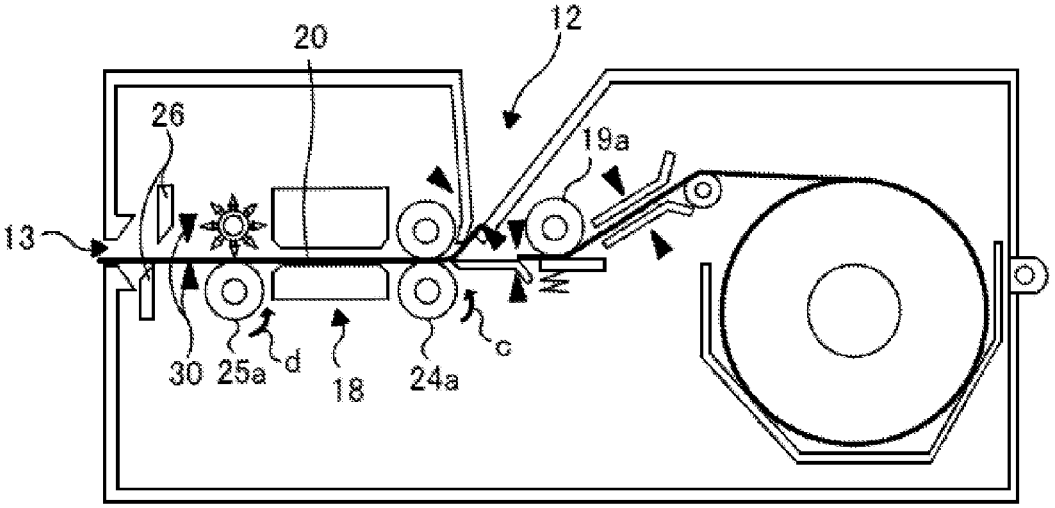
FIG. 8 is a schematic diagram illustrating the configuration for explaining the operation of the dual purpose printer according to an embodiment.

In the state when the first sensor 27 detects that a pre-cut paper sheet 20 is set on the slope 14*a* arranged on the cover member 14, an instruction to start single-side printing is issued from the operation section 36 to the CPU 31, putting the dual purpose printer in the standby state, and then activates the motors to rotate the conveyor roller 24*a* and the discharge roller 25*a* in the forward direction. Due to rotation of the conveyor roller 24*a* and discharge roller 25*a*, as shown in FIG. 8, the pre-cut paper sheet 20 is transported from the entrance port 12 to the first printing section 18. Then, the first printing section 18 carries out an inkjet printing operation on the outer or top (upper in the Fig.) side of the pre-cut paper sheet 20.

The printed pre-cut paper sheet 20 is then discharged from the discharge port 13 due to rotation of the discharge roller 25*a*. At this point, the single-side printing operation comes to an end.

During the single-side printing operation, the platen roller 19*a* and the cutting section 26 are not in operation.

As explained above, for the dual purpose printer 10 according to this embodiment, it is possible to carry out double-sided printing for the continuous sheet of paper 16' drawn from the paper roll 16 loaded in the housing 11. In the same printing apparatus, it is possible to carry out single-side printing on the pre-cut paper sheet 20 by moving the pre-cut paper sheet 20 in a slightly different, i.e., partial path from the paper 16, patch by inserting the pre-cut paper 20 through the entrance port 12 arranged on the housing 11.

With the dual purpose printer 10 according to this embodiment, while the paper roll 16 is loaded in the printer, printing can be carried out on pre-cut paper sheet 20. After printing on the pre-cut paper sheet 20, it is possible to immediately carry out the double-sided printing operation the continuous sheet of paper 16' pulled from the paper roll 16.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for printing on a first printing medium and a second printing medium in a dual purpose printer, the method comprising:

loading through an opening in a housing a rolled print medium into a printing medium supporting section wherein the printing medium supporting section rotatably supports the rolled print medium and wherein the opening has a lid in an open position during loading of the rolled print medium through the opening;

positioning the lid in a closed position wherein the lid is configured with an entrance port to accept the second printing medium therethrough; and printing, with a first printing section, on a top surface of the first printing medium fed from the rolled print medium;

printing, with a second printing section, on a bottom surface of the first printing medium fed from the rolled print medium;

withdrawing the first printing medium from the first printing section;

loading the second printing medium from the entrance port on the lid and into the first printing section; and printing on the second printing medium in the first printing section.

2. The method for printing on the first printing medium and the second printing medium in the dual purpose printer of claim 1, wherein the first printing medium, withdrawn from the first printing section, extends into the second printing section.

3. The method for printing on the first printing medium and the second printing medium in the dual purpose printer of claim 1, wherein the dual purpose printer is configured with a plurality of sensors which detect a location of the first printing medium and the second printing medium and a plurality of rollers configured to feed the first printing medium and the second printing medium in the dual purpose printer, wherein the plurality of rollers are configured to rotate in a forward direction and a backward direction for positioning of the first printing medium in the dual purpose printer.

4. A method for printing on a first printing medium and a second printing medium in a dual purpose printer, the method comprising:

loading a rolled print medium into a printing medium supporting section that rotatably supports the rolled print medium in a housing, the housing including: a lid that is in an open position during loading of the rolled print medium, and an entrance port to accept the second printing medium therethrough;

positioning the lid in a closed position; and printing, with a first printing section, on a top surface of the first printing medium fed from the rolled print medium;

printing, with a second printing section, on a bottom surface of the first printing medium fed from the rolled print medium;

withdrawing the first printing medium from the first printing section;

loading the second printing medium from the entrance port on the lid and into the first printing section; and printing on the second printing medium in the first printing section.

* * * * *